United States Patent [19]

Ogiso et al.

[11] Patent Number: 4,615,816

[45] Date of Patent: Oct. 7, 1986

[54] LUBRICATING AGENTS FOR PROCESSING YARNS AND METHOD OF PROCESSING THERMOPLASTIC YARNS THEREWITH

[75] Inventors: Osamu Ogiso; Ippei Noda, both of Aichi, Japan

[73] Assignee: Takemoto Yushi Kabushiki Kaisha, Gamagori, Japan

[21] Appl. No.: 731,135

[22] Filed: May 6, 1985

Related U.S. Application Data

[63] Continuation-in-part of Ser. No. 639,199, Aug. 9, 1984, abandoned.

[30] Foreign Application Priority Data

Oct. 18, 1983 [JP] Japan ..... 58-195437

[51] Int. Cl.[4] ..... D06M 11/00

[52] U.S. Cl. ..... 252/8.9; 252/52 A; 428/375; 528/370

[58] Field of Search ..... 252/8.9, 52 A; 428/375; 528/370

[56] References Cited

U.S. PATENT DOCUMENTS

| | | | |
|---|---|---|---|
| 2,787,632 | 4/1957 | Stevens et al. | 260/463 |
| 2,821,538 | 1/1958 | Dille et al. | 260/463 |
| 2,821,539 | 1/1958 | Newman et al. | 260/463 |
| 3,197,333 | 7/1965 | Schönfeldt et al. | 117/139.5 |
| 3,338,830 | 8/1967 | Stokes et al. | 252/8.9 |
| 3,348,968 | 10/1967 | Hulbert et al. | 117/138.8 |
| 3,379,693 | 4/1968 | Hostettler et al. | 260/77.5 |
| 3,632,828 | 1/1972 | Frevel et al. | 252/52 A |
| 3,975,280 | 8/1976 | Hachmann et al. | 252/102 |
| 4,111,819 | 9/1978 | Muijs | 252/8.9 |

FOREIGN PATENT DOCUMENTS

| | | |
|---|---|---|
| 569619 | 1/1959 | Canada . |
| 0673430 | 11/1963 | Canada . |
| 0872983 | 3/1959 | United Kingdom . |
| 0957686 | 5/1964 | United Kingdom . |

*Primary Examiner*—Paul Lieberman
*Assistant Examiner*—Willie J. Thompson
*Attorney, Agent, or Firm*—Flehr, Hohbach, Test, Albritton & Herbert

[57] ABSTRACT

New lubricating agents, or finishes, containing as principal constituent a polyalkylene ether polycarbonate compounds of a specified type are effective when used for the processing of thermoplastic synthetic yarns not only because they can provide lubricity and antistatic properties to the yarns but also because they can reduce the rate of generating tar and provide oil membranes of improved strengths.

6 Claims, No Drawings

LUBRICATING AGENTS FOR PROCESSING YARNS AND METHOD OF PROCESSING THERMOPLASTIC YARNS THEREWITH

This is a continuation-in-part of application Ser. No. 639,199 filed Aug. 9, 1984 now abandoned.

BACKGROUND OF THE INVENTION

This invention relates to new lubricating agents for processing yarns, or lubricating finishes of yarns and methods of processing thermoplastic synthetic yarns by using such lubricating agents, and more particularly to novel lubricating agents of a type never proposed before, having as their principal constituent polyalkylene ether carbonate to provide excellent lubricity and antistatic properties and to demonstrate much superior property regarding the rate of generating tar and strength in oil membranes as compared to conventional lubricating agents and methods of processing thermoplastic synthetic yarns by using such lubricating agents.

Various kinds of thermoplastic synthetic fibers such as polyester, polyamide, polypropylene, and polyacrylonitrile and cellulose-type yarns such as acetates are made into a cloth through processes such as weaving, drawing, false twisting, twisting and sizing as well as spinning and knitting; some of these processes may be combined into one process under certain circumstances. Various kinds of lubricating agents are used in these processes.

It has been well known that these lubricating agents must have lubricity and antistatic effects and be able to reduce the rate of generating tar. For this reason, use has long been made not only of mineral oils and aliphatic esters but also of polyoxyalkylene ethers (for example, U.S. Pat. No. 3,338,830). Of the lubricating agents which make use of these compounds, polyoxyalkylene ethers have the best properties regarding the rate of generating tar but they, too, cannot be sufficiently satisfactory under the severe conditions of thermal processing (such as draw-false twist-texturing with yarn speed in excess of 600 m/min).

It is therefore desirable to provide a lubricating agent with a better characteristic regarding the rate of generating tar than conventionally used polyoxyalkylene ethers. Nowadays, attempts are being made to increase the processing speed in order to improve the production efficiency while deniers of filament yarn are becoming finer for the fabrication of products of higher and more discriminating qualities. This tends to cause the sliding yarn to break more easily, more fuzz to appear and electrostatic problems to occur more frequently. In the case of high-speed draw-false twist texturing (with the yarn speed in excess of 600 m/min) of spin-draw process at high temperatures (over 200° C.), there is a strong demand for improvements regarding tar depositing on heaters and friction on metallic materials with which the sliding yarn comes into contact. Accordingly, it is not a matter of mere desire to make improvements on already available lubricating agents. There is a serious demand for new lubricating agents which, while maintaining the lubricity and antistatic properties of the conventional lubricating agents, stringently satisfy the requirements of significantly reducing the rate of generating tar and providing strong oil membranes.

SUMMARY OF THE INVENTION

As a result of research for the development of new lubricating agents in response to such demands, the present inventors have completed this invention by discovering that lubricating agents having as their principal constituent polyalkylene ether polycarbonate of a type never before proposed are the correct choice and that the desired effects can be obtained if such lubricating agents are applied to yarns.

DETAILED DESCRIPTION OF THE INVENTION

In one aspect, the present invention relates to a lubricating agent for processing yarns that contains a polyalkylene ether polycarbonate compound shown by the formula below:

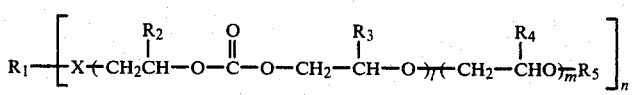

(I)

where $R_1$ is an organic residue obtainable by removing from an organic compound an active hydrogen group; $R_2$–$R_4$ may be the same or different, each representing hydrogen, methyl group or ethyl group; $R_5$ is hydrogen, alkyl group with 1 to 3 carbon atoms, alkanoyl group with 2 to 18 carbon atoms or trialkylsilyl group with 1 to 3 carbon atoms, X is —O—, —S—, —COO—, —N< or —CON<; l is an integer 1 or greater and preferably 2 or greater; m is 0 or an integer equal to or greater than 1; and n is an integer in the range of 1 to 8 such that the product ln is equal to or greater than 2.

In another aspect, the present invention relates to a method of processing thermoplastic synthetic yarns with a lubricating agent containing a polyalkylene ether polycarbonate compounds shown by (I) is applied at the rate of 0.1 to 3.0 weight % with respect to the thermoplastic synthetic yarns during a step prior to the conclusion of the filament drawing and orientation.

The polyalkylene ether polycarbonate compounds shown by (I) include:

(i) Those which are obtained by successive addition of cyclic alkylene carbonate shown by (II) to compounds containing an active hydrogen group within its molecule, and those obtained therefrom by alkylation, acylation or silylation of their terminal hydroxyl group ((I) with m=0):

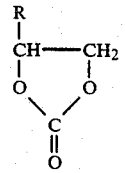

(II)

where R is hydrogen, methyl group or ethyl group; and (ii) Those obtained from the aforementioned active hydrogen compound by successive block-addition of aforementioned cyclic alkylene carbonate and alkylene oxide, and those obtained therefrom by alkylation, acylation or silylation of their terminal hydroxyl group ((I) with m≧1).

As described above, the polyalkylene ether polycarbonate compounds considered by the present invention vary greatly among themselves in terms both of chemical structure and of molecular weight. An appropriate choice out of these should be made in accordance with the production and working conditions of the yarn and, in particular, with the conditions of the heating process. In the case of a thermoset yarn with the drawing temperature in excess of 200° C., for example, compounds with molecular weight greater than about 700 are preferable for preventing fuming. If a high-speed draw-false twisting process is involved with a yarn speed exceeding 600 m/min, compounds with molecular weight greater than about 1500 are preferable because the lubricating agent is scattered around by the centrifugal force of the rotary motion of the twisted yarns. Since the polyalkylene ether polycarbonate carbonate compounds represented by the general formula (I) above are structurally different from the conventional type of polyalkylene ether in that a portion of the oxygen in ether radical of the latter is replaced by carbonate radical, the former compounds have the following characteristics, distinct from those of the polyoxyalkylene ethers:

(i) The amount of tar deposited on the heaters during the heat treatment process is extremely small; and (ii) Although their ability to reduce the coefficient of friction of yarns is nearly the same, the strength of oil membranes under a large load (by the testing method for load carrying capacity of petroleum products according to JIS-K-2519) is great so that the wear is much smaller on the various metallic parts which come into contact with the sliding yarns.

The polyalkylene ether polycarbonate carbonate compounds of the present invention can be synthesized by mixing an active hydrogen compound and cyclic alkylene carbonate (alkylene=ethylene, propylene or butylene) inside an atmospheric reactor, adding thereto an alkali metal compound (hydroxide, hydride or complex) as catalyst and heating and stirring the mixture at 100° to 200° C. for 2 to 5 hours. Decarboxylation of more than ½ mole may occur in this process but its extent varies, depending on the type of catalyst. For addition polymerizastion of alkylene oxide onto the reaction product, the reaction product is transferred into a pressure reactor into which alkylene oxide monomer is injected either singly or as a mixture of 110° to 150° C. and 1.0 to 5.0 kg/cm$^2$. After the end of the reaction, the alkali catalyst is either neutralized by an acid or through an adsorption process and then the mixture is filtered. The terminal hydroxyl group of polyalkylene ether carbonate compound thus obtained may be alkylated, acylated or silylated according to the usual method by a reaction with alkyl halide, acid halide, alkyl silyl halide, etc. Examples of such reactions are shown below:

(i) Alkylation: A polyalkylene ether polycarbonate compound is placed inside a pressure reactor together with an alkali compound such as potassium hydroxide and sodium hydroxide and is heated and stirred at about 100° C. while an excessive amount of methyl chloride is injected. After the reaction is completed, byproduct potassium chloride or sodium chloride is filtered out.

(ii) Acylation: A polyalkylene ether polycarbonate compound and carboxylic acid together with paratoluene sulfonic acid as catalyst are mixed in a reduced pressure reactor for dehydration and esterification at 100° to 120° C. and reduced pressure below 50 mmHg.

(iii) Silylation: A polyalkylene ether polycarbonate compound and its molar equivalent of pyridine are placed inside a reactor and trialkylsilyl chloride is gradually dropped into the mixture while it is heated and stirred at a temperature below 70° C. After the end of the reaction, the byproduct pyridine chloride is filtered out.

The following are examples of active hydrogen compounds which may be used for the synthesis of polyalkylene ether polycarbonates shown by the general formula (I): alcohols which are derived from natural aliphatic acid such as octyl alcohol, decyl alcohol, lauryl alcohol, myristyl alcohol, cetyl alcohol, stearyl alcohol, oleyl alcohol, behemyl alcohol, etc.; aldol condensation type synthetic alcohols such as 2-ethylhexanol, isocetyl alcohols (N.J. COL. 160B, for example, of Shin Nippon Rika Kabushiki Kaisha), isostearyl alcohol (DIADOL. 18, for example, of Mitsubishi Kasei Kabushiki Kaisha), etc.; oxo-synthesized alcohols such as isotridecanol, mixed straight chain- and iso-alcohols (DOBANOL 23, for example, of Mitsubishi Yuka Kabushiki Kaisha), etc.; lower alcohols such as methanol, ethanol, butanol, etc.; polyhydric alcohols such as ethylene glycol, propylene glycol, 1,4-butanediol, 1,6-hexanediol, thiodiglycol, trimethylolpropane, glycerol, thioglycerol, sorbitol, sugar, etc.; aliphatic acids such as decanoic acid, lauric acid, oleic acid, etc.; phenols such as octyl phenol, nonyl phenol, etc.; amines such as diethanolamine, diethylenetriamine, laurylamine, oleylamine, etc.; amides such as oleamide, lauramide, diethanololeamide, etc.; and polyglycol ethers which are obtained by adding ethylene oxide, 1,2-propylene oxide or 1,2-butylene oxide singly or mixed to the compounds above. Of the examples above, monohydric alcohols, polyhydric alcohols and phenols with 1 to 30 carbon atoms, and polyglycol ethers obtainable from the above by addition of alkylene oxide with 2 to 4 carbon atoms are preferable in view of the purposes of the present invention.

Some examples of polyalkylene ether polycarbonate compounds thus synthesized and used in the present invention are shown below, but it is not intended that the present invention is limited to these examples. In the chemical constitutional formulas (A) to (J) below, X, Y and Z represent $$X = -\overset{\overset{\displaystyle O}{\|}}{C}-O-,\ Y = -CH_2CH_2O- \text{ and } Z = -CH_2\overset{\overset{\displaystyle CH_3}{|}}{C}HO-$$

and r indicates random coupling.

(A): $C_8H_{17}$—O—(Y—X—Y)$_{10}$—H

Reaction product of 1 mole of octyl alcohol and 20 mole of ethylene carbonate.

(B): $C_8H_{17}$—O—(Y—X—Y)$_{10}$—(Y)$_{10}$—H

Addition product of compound (A) and 10 mole of ethylene oxide.

(C): $C_{12}H_{25}$—O—{(Z—X—Z)$_5$(Y—X—Y)$_5$}$_r$—{(Z)$_5$(Y)$_5$}$_r$—H

Random addition product of random reaction product of 1 mole of lauryl alcohol with 10 mole of propylene carbonate and 10 mole of ethylene carbonate and 5 mole each of propylene oxide and ethylene oxide.

(D): $CH_3$—O—(Y)$_{20}$—(Z—X—Z)$_{10}$—H

Reaction product of addition product of 1 mole of methanol and 20 mole of ethylene oxide and 20 mole of propylene carbonate.

$$\text{(E): } \begin{array}{l} CH_2-O-(Z-X-Z)_5-(Y)_{10}-H \\ | \\ CH_2-O-(Z-X-Z)_5-(Y)_{10}-H \end{array}$$

Addition product of reaction product between 1 mole of ethylene glycol and 20 mole of propylene carbonate and 20 mole of ethylene oxide.

$$\text{(F): } C_{12}H_{25}-\overset{\overset{\displaystyle CH_3}{|}}{N}-(Y)_{10}-(Y-X-Y)_{15}-H$$

Reaction product between addition product of 1 mole of lauryl methylamine and 10 mole of ethylene oxide and 30 mole of ethylene carbonate.

$$\text{(G): } C_7H_{15}\overset{\overset{\displaystyle O}{|}}{C}-O-\{(Z-X-Z)_{10}(Y-X-Y)_{10}\}_r-\{(Z)_{10}(Y)_{15}\}_r-H$$

Random addition product of random reaction product between 1 mole of octanoic acid, 20 mole of propylene carbonate and 20 mole of ethylene carbonate, 10 mol of propylene oxide and 15 mole of ethylene oxide.

(H): $C_8H_{17}-O-(Y-X-Y)_{10}-(Y)_{10}-CH_3$

Reaction product between compound (B) and methyl chloride.

$$\text{(I): } C_8H_{17}-O-(Y-X-Y)_{10}-(Y)_{10}-\overset{\overset{\displaystyle CH_3}{|}}{\underset{\underset{\displaystyle CH_3}{|}}{Si}}-CH_3$$

Reaction product between compound (B) and trimethylsilyl chloride.

$$\text{(J): } C_8H_{17}-O-(Y-X-Y)_{10}-(Y)_{10}-\overset{\overset{\displaystyle O}{||}}{C}-C_7H_{15}$$

Esterification reaction product between compound (B) and octanoic acid.

There is no particular limitation on the amount of these polyalkylene ether polycarbonate compounds which should be contained in the lubricating agent of the present invention as long as the desired effects of the invention are obtainable. In addition to such polyalkylene ether polycarbonate compounds, furthermore, the lubricating agents of the present invention may contain a lubricant, an antistatic agent, a non-ionic surface active agent, an emulsifier, a wetting agent, an anti-moulding agent and/or an anti-rusting agent in appropriate proportions.

Examples of such lubricant include refined mineral oils, aliphatic ether esters and polyethers derived from ethylene oxide or propylene oxide. Examples of aforementioned antistatic agent include anionic surface active agents such as sulfonates, phosphates and carboxylates, cationic surface active agents of the quaternary ammonium salt type and amphoteric surface active agents of the imidozoline type, betaine type and sulfobetaine type. Among the aforementioned non-ionic surface active agents are polyoxyethylene alkyl ether, polyoxyethylene alkylphenyl ether, polyoxyethylene alkyl ester and partial alkyl esters of polyhydric alcohols.

The lubricating agents of the present invention show their effectiveness when applied to fibers, filaments and yarns as spin finish or coning oil. They may be applied either as an aqueous emulsion, a solution with an organic solvent or by themselves (straight oiling). The amount of lubricating agent deposied on the yarn is usually 0.20 to 2.0 weight % when applied as spin finish and 0.5 to 3.0 weight % when used as coning oil.

The lubricating agents of the present invention are highly effective when applied to thermoplastic synthetic filaments and yarns such as polyesters, polyamides, polypropylene, polyacrylonitrile, etc., cellulose-type fibers such as acetates, and also many types of natural fibers. A comparison with the conventional lubricants and their constituents shows that aforementioned polyalkylene ether polycarbonate compounds which play central roles in these lubricating agents make it possible to obtain superior ability in oil membranes (so as to reduce the wears on the metallic materials with which sliding yarns come into contact). Furthermore, these polyalkylene ether polycarbonate carbonate compounds have many advantageous characteristics such that they can be synthesized easily and that materials which did not participate in the reaction can be removed easily.

When they are applied in the production of thermoplastic synthetic filaments and yarns such as polyesters, polyamides, polypropylene, polyacrilonitrile, etc., they are particularly effective if they are applied at the rate of 0.1 to 3.0 weight %, or preferably 0.2 to 2.0 weight % with respect to such synthetic filaments and yarns, and if it is done during a step prior to the completion of the drawing and orientation of the yarns because the aforementioned effects can continue throughout the subsequent production processes (inclusive of heating processes).

In order to explain the present invention and its effects more concretely, there will be show below examples of synthesis of polyalkylene ether polycarbonate compounds (hereafter abbreviated as PAC) related to the present invention as well as examples of comparison experiments and evaluation of their effectiveness. In what follows, symbols PAC(A) to (J) will refer to the individual examples (A) to (J) of polyalkylene ether polycarbonate compounds illustrated before.

EXAMPLE OF SYNTHESIS NO. 1 (SYNTHESIS OF PAC(A))

Octyl alcohol (130 g, or 1.0 mole) and ethylene carbonate (1760 g, or 20 mole) are placed inside a 3-liter glass reactor with an agitator and a reflux condenser and temperature was raised to about 80° C. with stirring. Agitation was made stronger and sodium borohydride (5.0 g) was gradually added as catalyst (for about 30 minutes). Temperature was gradually raised after the catalyst was added so that temperature was 180° C. after about 4 hour. Reaction was continued for one hour at this temperature. After the reaction was completed, temperature was lowered to 150° to 160° C. and the pressure of the reacting system was reduced to remove the small amount of unreacted substances by distillation. A filtration auxiliary was used next to obtain a highly viscous liquid by filtering. According to an analysis by the proton nuclear magnetic resonance method, the rate of decarboxylation was about 55% (5% greater than the theoretical value).

EXAMPLE OF SYNTHESIS NO. 2 (SYNTHESIS OF PAC(B))

PAC(A) synthesized by the process of Example No. 1 (1450 g, or 1.0 mole) and potassium hydroxide (4.7 g) in the form of flakes were placed inside a 3-liter pressure reactor of stainless steel. They were agitated and heated, and after the potassium hydroxide was dispersed, ethylene oxide (440 g, or 10 mole) was gradually injected for about 1 hour while the reacting system was maintained at 100° to 120° C. After this is completed, agitation was continued for about one hour at the same temperature till the reaction was completed. After the addition reaction of ethylene oxide was completed, the reaction product was cooled to below 50° C. and then taken out of the reactor. Potassium hydroxide was filtered away by adsorption by an alkali adsorbent and a liquid with high viscosity was obtained.

EXAMPLES OF TEST AND COMPARISON EXPERIMENTS NOS. 1 TO 3

Lubricants for test and comparison experiments Nos. 1 to 3 shown in Table 1 were individually prepared. A 10-weight % emulsion each of these lubricating agents was applied individually by the kiss-roll method onto commercially available nylon yarn (semi-dull 70-denier, 24-filament) degreased by cyclohexane and dried. The amount of lubricating agent deposited was 0.8 to 1.0 weight %. Coefficient of friction and the rate of wear on knitting needles were measured for each yarn and the load carrying capacity of each lubricating agent was measured by the testing method for load carrying capacity of petroleum products (by JIS-K-2519). The results are shown in Table 1.

Table 1 essentially shows the effects of the presence of polyalkylene ether polycarbonate group. It can be clearly understood from these results that the present lubricants are much superior to the conventional polyoxyalkylene ether type lubricants regarding the degree of wear of knitting needles and the load carrying capacity, but they are about the same regarding the coefficient of friction between yarn and metal.

Evaluations reported in Table 1 were made as follows:

(i) Measurement of Coefficient of Friction

Sample nylon yarns processed with lubricating agents were used and measurements were taken under the following conditions by using a $\mu$-meter (product of Eiko Sokuki Kabushiki Kaisha).

Friction pin = Cylindrical plated pin having rough surface and diameter of 25 mm Contact angle between filament and friction pin = 90°

Initial tension ($T_1$) = 20 g

Sliding speed of yarn = 300 m/min

Environment = 25° C. × 65% RH

The yarn tension immediately after the friction pin ($T_2$) was measured and the coefficient of friction was calculated by the following formula:

$$\text{Coefficient of friction} = A \ln T_2/T_1$$

where A is a factor determined by the angle of contact and ln is the natural logarithm. Lubricity is the better, the smaller the coefficient of friction.

(ii) Measurement of the Wear on Knitting Needle

After aforementioned nylon sample yarns were run in contact with a knitting needle for tricot under the following conditions, the friction surface of the needle was observed microscopically to check the presence of any mark of wear:

Sliding speed of yarn = 400 m/min.

Tension = 40 g

Angle of contact between knitting needle and sliding filament = 150°

Environment = 25° C. × 75% RH.

(iii) Measurement of Load Carrying Capacity

By the testing method for load carrying capacity of petroleum products according to K2519 of JIS, the value (kg/cm) indicated by the oil pressure gauge was measured when glazing of the test spheres occurs.

(iv) Standards of Evaluation

Evaluations were made according to the following standards:

| | Coefficient of friction | | Wear on knitting needle | | Load carrying capacity |
|---|---|---|---|---|---|
| | 0.30–0.35 | | Trace of wear | | Over 13 |
| Δ | Over 0.35 | × | No trace of wear | Δ | 8–13 |
| | | | | × | Less than 8 |

TABLE 1

| | Test example | | | Comparison | | |
|---|---|---|---|---|---|---|
| | 1 | 2 | 3 | 1 | 2 | 3 |
| PAC(A) | 89 | | | | | |
| PAC(C) | | 89 | | | | |
| PAC(E) | | | 89 | | | |
| (A-1) | | | | 89 | | |
| (C-1) | | | | | 89 | |
| (E-1) | | | | | | 89 |
| *1 | 1 | 1 | 1 | 1 | 1 | 1 |
| *2 | 10 | 10 | 10 | 10 | 10 | 10 |
| Coef. Fric. | O | O | O | O | O | O |
| Wear | O | O | O | X | X | X |
| Load Cap. | O | O | O | X | X | X |

where (A-1): $C_8H_{17}—O—(CH_2CH_2O)_{20}—H$

Reaction product of 1 mole of octyl alcohol and 20 mole of ethylene oxide.

(C-1): $C_{12}H_{25}—O—\{(CH_2\overset{\overset{CH_3}{|}}{C}HO)_{15}(CH_2CH_2O)_{15}\}—H$ Random reaction product of 1 mole of dodecyl alcohol, 15 mole of propylene oxide and 15 mole of ethylene oxide.

(E-1): Reaction product of 1 mole of ethylene glycol and 20 mole of propylene oxide and 20 mole of ethylene oxide.

*1: Sodium alkylsulfonate

*2: Polyoxyethylene (10 mole) dodecyl ether.

EXAMPLES OF TEST EXPERIMENTS NOS. 4 TO 9 AND COMPARISON EXPERIMENTS NOS. 4 AND 5

Lubricating agents for test experiments Nos. 4 to 9 and comparison experiments Nos. 4 and 5 shown in Table 2 were individually prepared. These lubricating agents were individually used to fabricate partially oriented yarns (POY) by the following method and these yarns were used for draw-twist testuring to evaluate the conditions of tar deposited on the heaters. The results are shown in Table 2. Table 2, too, shows clearly that deposition of tar is hardly observed on the heaters if a lubricating agent of the present invention is used.

(i) Making of POY

Immediately after melt spinning of polyethylene terephthalate, a 10%-emulsion of lubricating agent was applied to the yarn by the kiss-roll method and a 12-kg cake of 115-denier, 36-filament POY was obtained by winding at the rate of 3500 m/min. The amount of lubricating agent deposited on POY was 0.4 to 0.5 weight %.

(ii) Draw-False Twist Texturing

This was carried out under the following conditions:

Twisting system = Three-axis friction method (hard urethane rubber disk)

Speed of yarn = 600 m/min

Draw ratio = 1.518

Heater on twist side = 2 m in length with surface temperature of 220° C.

Heater on untwisting side = None

Intended number of twisting = 3200T/m (iii) Evaluation of Tar on Heaters

After a continuous operation for 10 days under the aforementioned conditions of draw-false twisting, appearance of tar in the yarn passages on the twist side was checked by a magnifier. The result was evaluated according to the following standards:

O = Tar deposition was hardly observable

X = Tar deposition was clearly observable.

TABLE 2

| | Test experiments | | | | | | Comparison | |
|---|---|---|---|---|---|---|---|---|
| | 4 | 5 | 6 | 7 | 8 | 9 | 4 | 5 |
| PAC(B) | | 60 | | 30 | | 30 | | |
| PAC(D) | | | 60 | | 30 | | | |
| PAC(G) | 99 | | | | | 39 | | |
| *3 | | 39 | 39 | 69 | 69 | | 99 | 69 |
| *4 | | | | | | 30 | | 30 |
| *5 | 1 | 1 | 1 | 1 | 1 | 1 | 1 | 1 |
| Tar on heaters | O | O | O | O | O | O | X | X |

where

*3: Polyether of average molecular weight 2500 obtained by addition of propylene oxide and ethylene oxide in weight ratio of 1:1 to butanol.

*4: Ester compound of the following chemical structure:

$$C_{12}H_{25}-O-(CH_2CH_2O)_5-\underset{\underset{O}{\|}}{C}-C_9H_{19}$$

*5: Potassium dodecenyl succinate.

We claim:

1. A lubricating agent for processing yarns, said lubricating agent containing polyalkylene ether polycarbonate compounds shown by the general formula (I) below:

$$R_1XCH_2\overset{\overset{R_2}{|}}{C}H-O-\overset{\overset{O}{\|}}{C}-O-CH_2\overset{\overset{R_3}{|}}{C}H-O\left(CH_2-\overset{\overset{R_4}{|}}{C}HO\right)_m-R_5 \quad (I)$$

where $R_1$ is an organic residue obtainable by removing an active hydrogen group from an organic compound; $R_2$ to $R_4$ may be similar or different, each being hydrogen, methyl group or ethyl group; $R_5$ is hydrogen, alkyl group with 1 to 3 carbon atoms, alkanoyl group with 2 to 18 carbon atoms or trialkylsilyl group with 1 to 3 carbon atoms; X is —O—, —S—, —COO—, —N< or —CON<; l is an integer equal to or larger than 1; m is 0 or an integer equal to or larger than 1; and n is an integer in the range of 1 to 8 such that the product ln is equal to or greater than 2.

2. The lubricating agent of claim 1 wherein said organic compound is monohydric alcohol with 1 to 30 carbon atoms, polyhydric alcohol with 1 to 30 carbon atoms, phenol with 1 to 30 carbon atoms or polyglycolether obtainable therefrom by addition of alkylene oxide with 2 to 4 carbon atoms.

3. A method of processing thermoplastic synthetic yarns, said method comprising the step of applying a lubricating agent at a rate of 0.1 to 3.0 weight δ with respect to said yarns in a process prior to the completion of drawing and orientation of said yarns in the production process thereof, said lubricating agent containing a polyalkylene ether polycarbonate compound shown by the formula (I) below:

$$R_1-\left[X\left(CH_2\overset{\overset{R_2}{|}}{C}H-O-\overset{\overset{O}{\|}}{C}-O-CH_2-\overset{\overset{R_3}{|}}{C}H-O\right)_l\left(CH_2-\overset{\overset{R_4}{|}}{C}HO\right)_m-R_5\right]_n \quad (I)$$

where $R_1$ is an organic residue obtainable by removing an active hydrogen group from an organic compound; $R_2$ to $R_4$ may be similar or different, each being hydrogen, methyl group or ethyl group; $R_5$ is hydrogen, alkyl group with 1 to 3 carbon atoms, alkanoyl group with 2 to 18 carbon atoms or trialkylsilyl group with 1 to 3 carbon atoms; X is —O—, —S—, —COO—, —N< or —CON<; l is an integer equal to or larger than 1; m is 0 or an integer equal to or larger than 1; and n is an integer in the range of 1 to 8 such that the product ln is equal to or greater than 2.

4. The method of claim 3 wherein said organic compound is monohydric alcohol with 1 to 30 carbon atoms, polyhydric alcohol with 1 to 30 carbon atoms, phenol with 1 to 30 carbon atoms or polyglycolether obtainable therefrom by addition of alkylene oxide with 2 to 4 carbon atoms.

5. The lubricating agent of claim 1 wherein l is equal to or larger than 2.

6. The method of claim 3 wherein l is equal to or larger than 2.

* * * * *